US005963193A

United States Patent [19]

Knox et al.

[11] Patent Number: 5,963,193

[45] Date of Patent: Oct. 5, 1999

[54] DISPLAY APPARATUS WITH DIGITAL OUTPUT PALETTE

[75] Inventors: Andrew Knox, Kilbirnie; Christopher Carlo Pietrzak, Renfrewshire, both of United Kingdom

[73] Assignee: International Business Machines Corporation, Armonk, N.Y.

[21] Appl. No.: 08/732,804

[22] Filed: Oct. 15, 1996

[30] Foreign Application Priority Data

Feb. 5, 1996 [GB] United Kingdom ..... 9602293

[51] Int. Cl.[6] ..... G09G 5/02

[52] U.S. Cl. ..... 345/150; 345/213; 345/197

[58] Field of Search ..... 345/150, 139, 345/523, 119, 100, 94, 198, 211, 213, 507, 509, 197, 513; 348/615

[56] References Cited

U.S. PATENT DOCUMENTS

| | | | |
|---|---|---|---|
| 4,827,255 | 5/1989 | Ishii | 345/148 |
| 5,293,468 | 3/1994 | Nye et al. | 345/431 |
| 5,384,912 | 1/1995 | Ogrinc et al. | 345/523 |
| 5,495,298 | 2/1996 | Uchida et al. | 348/615 |
| 5,543,819 | 8/1996 | Farwell et al. | 345/150 |
| 5,621,425 | 4/1997 | Hoshino et al. | 345/94 |

FOREIGN PATENT DOCUMENTS 0460951 12/1991 European Pat. Off. ..... G06F 3/14

*Primary Examiner*—Richard A. Hjerpe
*Assistant Examiner*—Francis Nguyen
*Attorney, Agent, or Firm*—Bernard D. Bogdon

[57] ABSTRACT

A display system comprises a digital video source coupled to a digital display device via an digital interface having a timing channel for carrying a pixel clock signal from the video source to the display device and a digital video channel for carrying a digital video bit stream from the video source to the display device. The video source comprises a pixel clock generator for generating the pixel clock signal, palette logic for outputting a pixel word on each pulse of the pixel clock signal, shift clock logic for multiplying the pixel clock signal by the number of bits in the pixel word to produce a shift clock signal, and serialiser logic for serially outputting the pixel word in the serial bit stream at the shift clock signal rate. The display device comprises a display screen for producing a pixel of an image in response to the pixel word; shift clock generator logic for multiplying the pixel clock signal by the number of bits in the pixel word, and deserialiser logic for receiving the input video bit stream at the shift clock signal rate to re-generate the pixel word from the video bit stream.

14 Claims, 4 Drawing Sheets

DISPLAY APPARATUS WITH DIGITAL OUTPUT PALETTE

Applicants claim the foreign priority benefits under 35 U.S.C. 119 of United Kingdom Application No. 9602293.4 filed Feb. 5, 1996. This United Kingdom Application is incorporated by reference into this Specification.

TECHNICAL FIELD

The present invention relates to an apparatus for generating serial video bit streams, display apparatus for receiving such serial video bit streams, and display systems comprising such apparatus.

BACKGROUND

A typical display system comprises a display device such as a cathode ray tube (CRT) display and a host computer system connected to the display device. In operation, the computer system generates image data for producing a picture on the screen of the display device. Conventionally, the computer system initially generates the image data in the digital domain. A digital to analog convertor in the computer system then converts the image data into analog video signals for transfer to the display device. Such display systems provide acceptable performance provided the display device is responsive to analog video signals. However, some display devices, for example liquid crystal display screens, require a digital video signal.

Furthermore, some display devices include digital signal processing systems for processing input video signals in the interest of performance enhancement. The operation of such display devices, hereinafter referred to as digital display devices, is dependent on the conversion of the analog video signal generated by the computer system back into the digital domain. However, such conversion introduces noise and instability to the display system. In conventional systems, each pixel of an image is represented by a fixed number of bits. Therefore each pixel has a correspondingly finite colour depth. Current liquid crystal displays allocate between 4 and 6 bits per colour. However, in more recent digital display technologies, the colour depth is 8 bits per colour. Some digital video output devices or "Palettes" can now provide 10 bits per colour. Furthermore, the number of bits per colour can vary in such Palettes from one colour to the next. Typically, green is allocated more bits than red and blue, for example. As the cost of integrated electronic display devices such as liquid crystal display panels reduces, a corresponding market trend is emerging towards digital display devices in preference to conventional analog display technologies. It will be appreciated that such digital displays may be categorised in the market-place by screen-size, refresh rate, resolution, and colour depth.

SUMMARY OF THE INVENTION

In accordance with the present invention there is now provided a display system comprising a digital video source coupled to a digital display device via a digital interface having a timing channel for carrying a pixel clock signal from the video source to the display device and a digital video channel for carrying a digital video bit stream from the video source to the display device, wherein the video source comprises a pixel clock generator for generating the pixel clock signal, palette logic for outputting a pixel word on each pulse of the pixel clock signal, first shift is clock logic for multiplying the pixel clock signal by the number of bits in the pixel word to produce a shift clock signal, and serialiser logic for serially outputting the pixel word in the serial bit stream at the shift clock signal rate, and wherein the display device includes a display screen for producing a pixel of an image in response to the pixel word; second shift clock logic for multiplying the pixel clock signal by the number of bits in the pixel word, and deserialiser logic for receiving the input video bit stream at the shift clock signal rate to re-generate the pixel word from the video bit stream.

Preferably, the interface comprises a control channel for communicating the number of bits in the pixel word from the video source to the display device.

It will be appreciated that the present invention extends to a computer system comprising a processor, a memory, and such a display system.

Viewing the present invention from another aspect, there is now provided apparatus for generating a serial video bit stream, the apparatus includes: a pixel clock generator for generating a pixel clock signal; palette logic for generating a pixel data word on each pulse of the pixel clock signal; shift clock generator logic for multiplying the pixel clock signal by the number of bits in the pixel data word to produce a shift clock signal; and, serialiser logic for outputting the pixel data word in a serial bit stream at the shift clock signal rate.

Preferably, control logic is connected to the shift clock generator logic for reading the number of bits in the pixel data word from an external source.

In a preferred embodiment of the present invention, there is provided cross-point switch logic for transferring the pixel data word generated by the palette logic to the serialiser logic.

In a particularly preferred embodiment of the present invention, there is provided error logic for generating an error code corresponding to the pixel data word and for adding the error code to the serial bit stream.

Viewing the present invention from yet another aspect, there is now provided display apparatus including a display screen for producing a pixel of an image at least partially in response to a pixel word; a timing receiver for receiving a pixel clock signal from an external video source; shift clock generator logic for multiplying the pixel clock signal by the number of bits in the pixel word to generate a shift clock signal; and, deserialiser logic for receiving an input video bit stream at the shift clock signal rate to generate the pixel word.

Preferably, the display apparatus includes control logic connected to the shift clock generator logic for reading the number of bits in the pixel data word from an external source.

In a preferred example of display apparatus of the present invention there is provided error logic for detecting an error in the pixel word and from an error code in the serial bit stream.

In some embodiments of the present invention, the pixel word defines a pixel of a monochrome video image. However, in other embodiments of the present invention, the pixel word defines a colour component of a pixel of a colour video image.

The present invention advantageously provides a display interface which is capable of linking a video source such as a computer system unit or work-station to any one of a range of digital display devices irrespective of refresh rate, colour depth, and resolution. Such compatibility is achieved by providing the interface with variable colour depth, a timing channel, and a simple configuration method.

BRIEF DESCRIPTION OF THE DRAWINGS

Preferred embodiments of the present invention will now be described, by way of example only, with reference to the accompanying drawings, in which.

DETAILED DESCRIPTION OF THE PREFERRED EMBODIMENT

Figure 1:
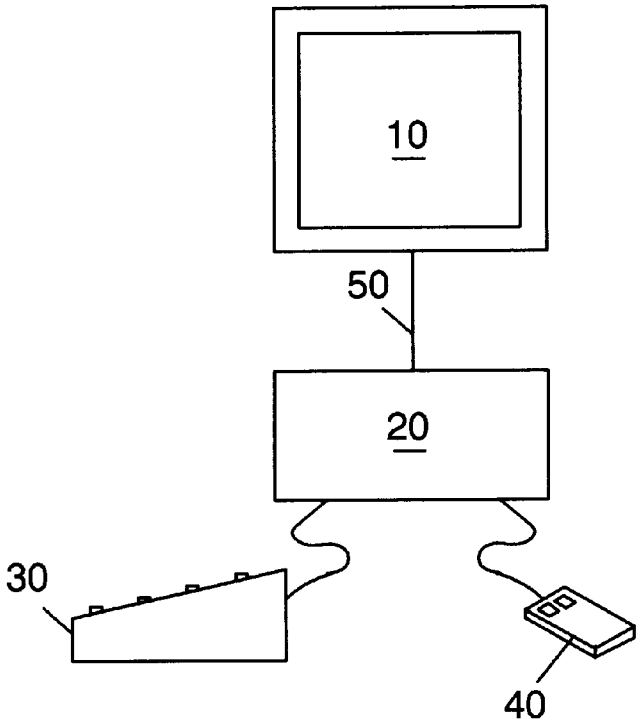
FIG. 1 is a block diagram of an example of a display system embodying the present invention.

Referring first to FIG. 1, an example of a display system of the present invention comprises a digital display device 10 such as a liquid crystal display, projection display, cathode ray tube display, or the like. A computer system unit 20 such as a personal computer, work-station, or the like, has an internal video output sub-system connected to display device 10 via an interface 50. Input devices, including a keyboard 30 and pointing device 40 are connected to data input ports of system unit 20. Pointing device may be in the form of a mouse, tracker ball, joystick, touch-screen, or the like. System unit 20 comprises a central processing unit (CPU) such as a microprocessor, memory, and mass data storage means such as a hard disk drive all interconnected by a bus architecture. Bus architecture further extends to the video sub-system, the data input ports, and additional data output ports for connection to, for example, a printer. In operation, CPU executes computer program code stored in the memory or retrieved from the mass storage means to produce, via the video sub-system, digital video signals for driving display device 10 to generate a visual output. A user can control execution of the program code by the CPU via keyboard 30 and pointing device 40

Figure 2:
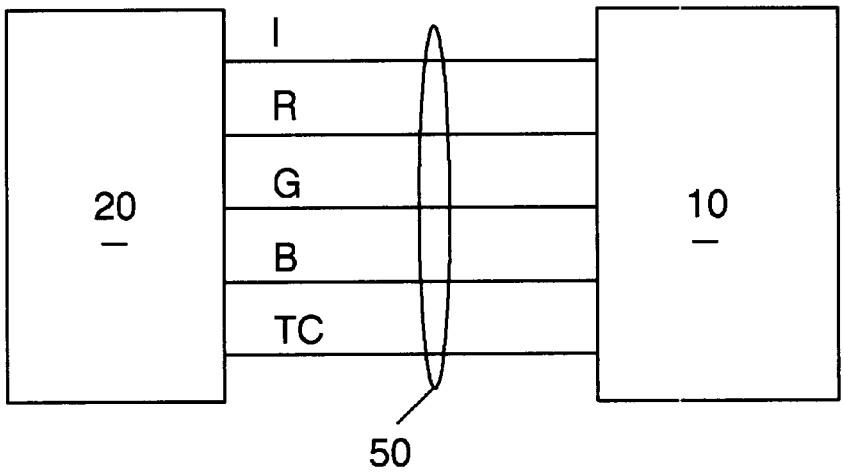
FIG. 2 is a simplified diagram of an interface of the display system of FIG. 1.

Referring to FIG. 2, interface 50 comprises: Red, Green, and Blue digital video channels R, G, and B; a timing channel TC; and, a control channel 1.

Figure 3:
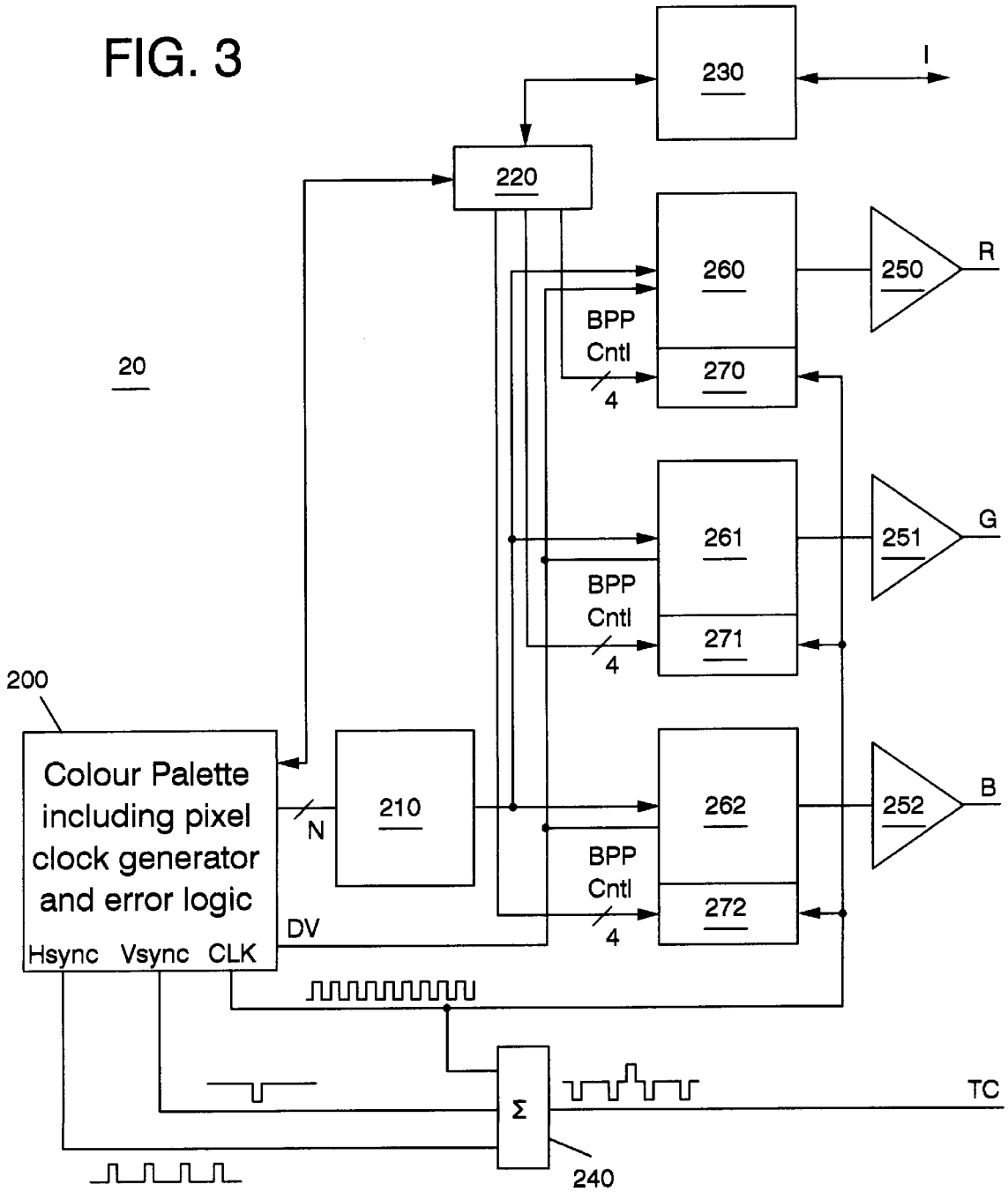
FIG. 3 is a block diagram of a video source of the display system of FIG. 1.

Referring now to FIG. 3, the video sub-system of system unit 20 comprises a colour digital output palette 200 having an N bit video data output, a pixel clock output CLK, a data valid output DV, and line and frame sync outputs Hsync and Vsync. The N video data output is connected to an N×N cross-point switch 210. Sync outputs Hsync and Vsync and pixel clock output CLK provide inputs to a summing logic block 240. The output of summing block 240 provides timing channel TC of interface 50. The output of cross-point 210 is connected to each of three parallel input serial output shift registers 260–262. Each of registers 260–262 has phase locked loop and counter logic 270–271. The data valid output of palette 200 is connected to an enable input of each of registers 260–262. The serial output of each register 260–262 is connected, via a buffer amplifier 250–252, to a different one of video channels R, G, and B of interface 50. Each channel R, G, and B corresponds to a different one of the three primary colours, i.e., Red, Green and Blue. Control channel I of interface cable 50 is connected to a communications logic block 230. A control logic block 220 is coupled to logic block 230 and palette 200. Control logic block 220 has three control outputs BPP Cntl each 4 bits wide and each connected to a different one of phase locked loop and counter logic blocks 270–272. The pixel clock output CLK from Palette 200 is also connected to each of logic blocks 270–272.

In operation, data to be displayed on display device 10 is written by the CPU of system unit 20 to a video memory (not shown) of the video sub-system. The data stored in the video memory is converted by palette 200 into a colour data set for each pixel of the image to be displayed on display device 10. The pixel data set corresponding to each pixel is presented in parallel at the output of palette 200 as an N bit wide word. Data valid signal DV is generated by palette 200 shortly thereafter to indicate that the N bit word has stabilised. Each of the primary colours for a pixel is represented by a different sub-set of bits of the corresponding N bit word. Thus all three colours are presented simultaneously. For example, the N bit word may be 16 bits wide and the Red, Green and Blue colour data may be 5, 6, and 5 bits wide respectively. Palette 200 also generates a pixel clock signal CLK synchronised to presentation of each N bit word.

Each N bit word is routed, via cross point switch 210, to registers 260–262. The operation of cross point switch 210 will be described in detail shortly. Specifically, the red colour data is routed to register 260; the green colour data is routed to register 261; and the blue colour data is routed to register 262. Each colour data subset is loaded into the corresponding register in parallel in response to data valid signal DV. Each register 260–262 acts as a serialiser. Specifically, each register sequentially sends bits of colour data along the corresponding video channel to display device 10. The rate of transmission of bits from each register 260–262 to display device 10 is higher than the pixel clock by a factor equal to the number of bits constituting the corresponding colour data. The rate of transmission from the shift register is controlled by a shift register clock. The shift register clock is generated by the corresponding phase locked loop and counter logic 270–272. The corresponding phase locked loop and counter logic multiplies pixel clock signal CLK by the number of bits constituting the corresponding colour data to generate the shift register clock. Each colour data is thus transmitted at the shift register clock frequency of the corresponding register 260–262. The phase locked loop and counter logic 270–272 of each register 260–262 is programmed with a corresponding bits per pixel value BPP Cntl by control logic block 220. In the FIG. 3 arrangement, each BPP Cntl value is allocated 4 bits. This allows a maximum of 16 states or 15 bits per pixel (where a value 0 effectively disables the corresponding channel). 15 bits per pixel permits 32768 shades of a single primary colour or a maximum of $2^4=3.5\times10^{13}$ colours for an individual pixel. Such level of variation is greater than that resolvable by the human eye.

In modification to the FIG. 3 arrangement, there is provided error logic for producing a parity bit, CRC (cyclic redundancy check) checksum, or other error code for permitting error detection. The error code is sent with the pixel data and decoded in display device 10. It will be appreciated that display device 10 may, in turn, comprise error correction logic for correcting received data based on the decoded error code.

Summing logic 240 sums sync signals Hsync and Vsync and pixel clock signal CLK (or at least a sub-multiple thereof) to generate a composite timing signal on timing channel TC of interface 50. In preferred embodiments of the present invention, pixel clock signal CLK is filtered to reduce high frequency content and reduced in amplitude prior to summation to minimize potential for electromagnetic interference.

Figure 4:
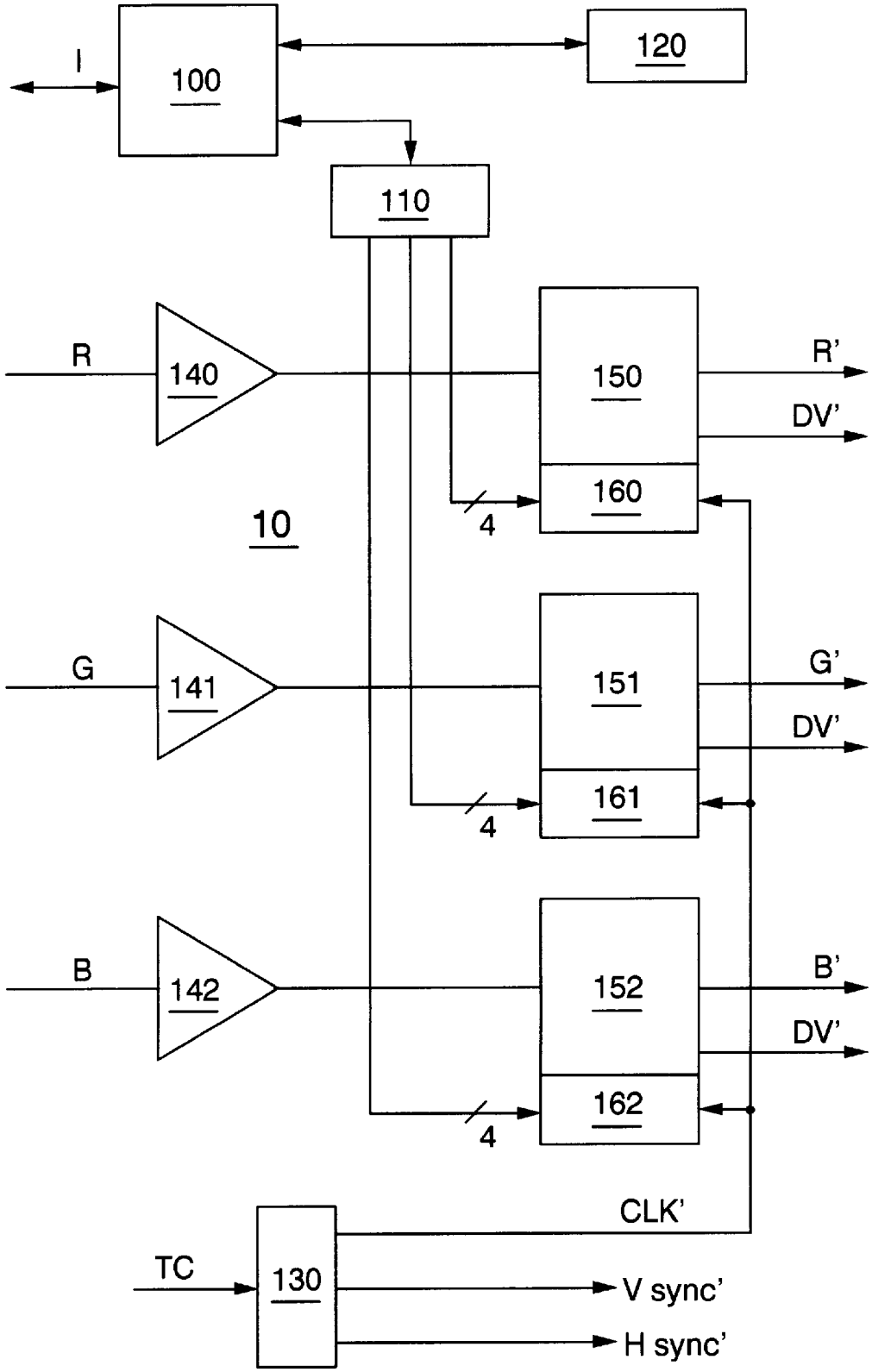
FIG. 4 is a block diagram of a display device of the display system of FIG. 1; and, FIG. 5 is a flow diagram corresponding to the display system of FIG. 1.

Referring now to FIG. 4, display device 10 comprises a communications logic block 100 connected to control channel I of interface 50. Communications logic block 100 is connected to a display processor 120 of display device 10 and a control logic block 110. The red, green and blue video channels R, G, and B of interface 50 are each connected, via a buffer amplifier 140–142, to a different one of a group of three serial input parallel output shift registers 150–152. Each of registers 150–152 comprises phase locked loop and counter logic 160–162. Control logic block 110 has three control outputs each 4 bits wide and each connected to different one of phase locked loop and control logic 160–162. Each register 150–152 has a data valid output DV in addition to a parallel colour data output R', G' and B'. Timing channel TC of interface 50 is connected to a timing separation logic block 130 having a pixel clock output CLK' and line and frame sync outputs Hsync' and Vsync'. Pixel clock output CLK' is connected to the each of logic blocks 160–162.

In operation, buffer amplifiers 140–142 receive serial colour data bits for each pixel from the corresponding video channels R, G, and B. The received data bits are delivered by buffer amplifiers 140–142 to the serial inputs of the corresponding registers 150–152. Sync separator logic 130 separates line and frame sync signals Hsync and Vsync from the composite signal on timing channel TC of interface 50. Separator logic 130 also includes clock recovery logic for recovering pixel clock signal CLK' from the composite timing signal.

The bits per pixel value for each video channel is recovered by communications logic 100 from control channel I of interface 50. Communication logic 100 supplies the bits per pixel values to control logic 110. Control logic 110 programs phase locked loop and counter logic 160–162 of registers 150–152 as a function of the received bits per pixel values. Each register 150–152 sequentially loads bits of colour data from the corresponding video channel R, G, and B. The rate of reception of bits by each register 150–152 is higher than recovered pixel clock CLK by a factor equal to the number of bits constituting the corresponding colour data. The rate of reception by the register 150–152 is controlled by a shift register clock. The shift register clock is generated by the corresponding phase locked loop and counter logic 160–162. The corresponding phase locked loop and counter logic 160–162 multiplies recovered pixel clock signal CLK' by the number of bits constituting the corresponding colour data to generate the shift register clock. Each colour data is thus received at the shift register clock frequency of the corresponding register 150–152. As mentioned above, the phase locked loop and counter logic 160–162 of each register 150–152 is programmed with a corresponding bits per pixel value by control logic block 110. Thus the colour data R', G', and B' is presented at the parallel output of the corresponding registers 160–162' simultaneously thereby reconstructing the N bit pixel data word. Each register 150–152 generates a data valid signal DV to indicate that the corresponding colour data at the parallel output of the register 150–152 has stabilised. It will be appreciated that each register 150–152 acts as a deserialiser.

Figure 5:
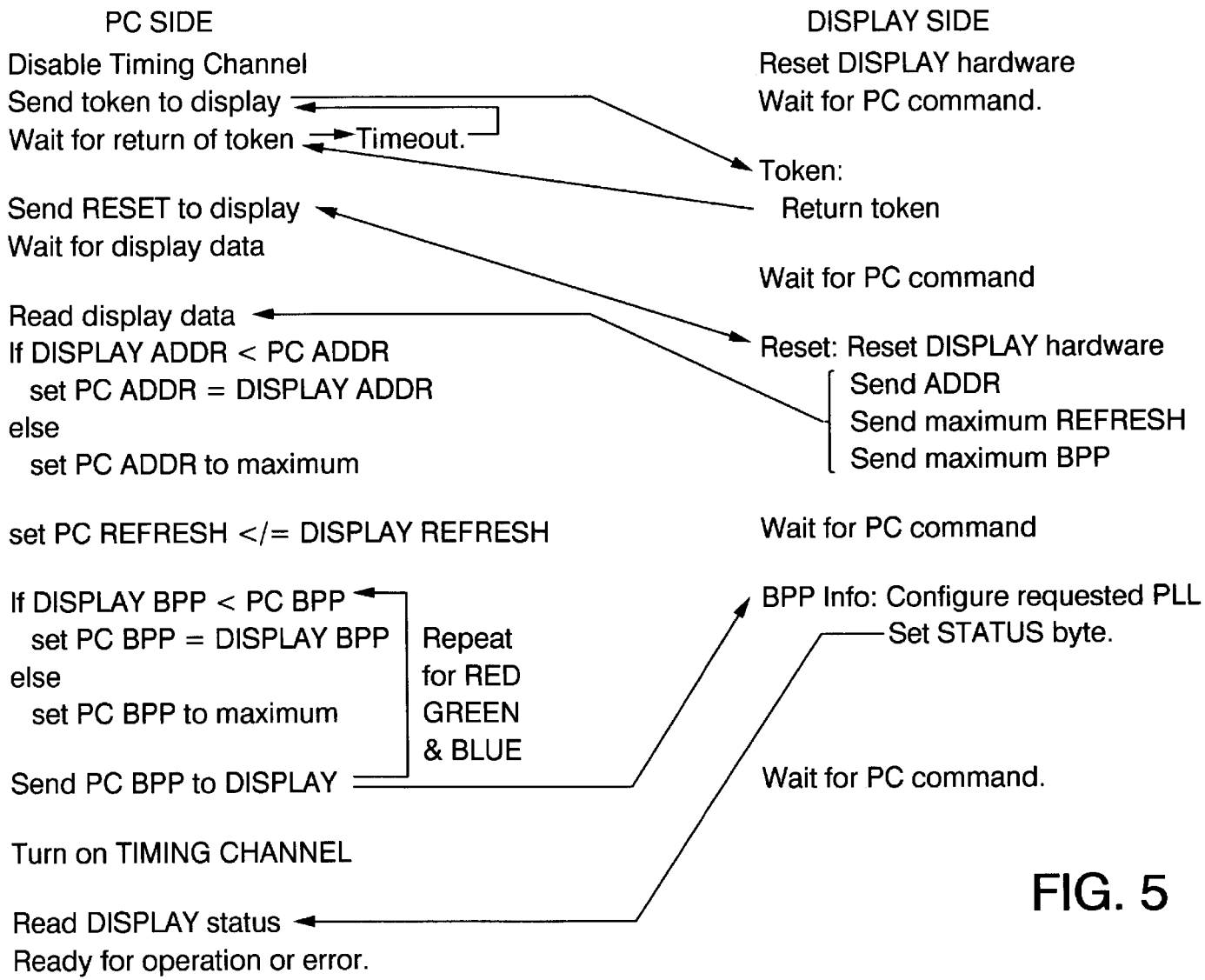

Referring now to FIG. 5, a preferred initialisation sequence for the examples of the present invention hereinbefore described commences in system unit 20 by the video sub-system disabling timing channel TC. In display device 10, the sequence commences with display processor 120 resetting the display drive circuitry and then waiting for a command from system unit 10. With the timing channel disabled, the video sub-system then sends a token to the display device 10 via control channel I of interface 50 and waits for the display device to return the token, again via control channel 1. If, after a predetermined period of time the video sub-system has yet to receive the token from display device 10, the video sub-system sends another token. Upon receipt of the token from the display device 10, the video sub-system sends a RESET instruction to display device 10. Display Device 10 responds to the RESET instruction by resetting the display drive circuitry and by sending video sub-system performance data, indicative of the operating parameters of display device 10, via control channel I. Specifically the performance data comprises pixel addressability (or resolution) ADDR; maximum REFRESH rate; and maximum BPP (bits per pixel) for each video channel R, G, and B. Display device 10 then waits for the next command from the video sub-system. The video sub-system reads the performance data sent by display device 10. If the addressability value received from display device 10, DISPLAY ADDR, is less than the addressability value currently retained by the video sub-system, PC ADDR, then the video sub-system sets PC ADDR to DISPLAY ADDR. Otherwise, the video sub-system sets PC ADDR to maximum. If the refresh rate, PC REFRESH, stored in the video sub-system is greater than the refresh rate, DISPLAY REFRESH, received from display device 10, then the video sub-system sets PC REFRESH to less than or equal to DISPLAY REFRESH.

Furthermore, for each video channel R, G, and B, if the corresponding bits per pixel value received from display device 10, DISPLAY BPP is less than the corresponding bits per pixel value stored by the video sub-system, PC BPP, then the video sub-system sets PC BPP to DISPLAY BPP. Otherwise, the video sub-system sets PC BPP to maximum. The video sub-system then sends the bits per pixel value, PC BPP, for each video channel R, G, and B, to display device 10 via control channel I. As hereinbefore described, upon receipt of the bits per pixel values corresponding to video channels R, G, and B, display device 10 programs the phase locked loop and counter logic 160–162 of each register 150–152 in preparation to receive video data streams from the video sub-system. Display processor 120 then sets a STATUS code to indicate that display device 10 is ready for operation. Display device 10 then waits for the next command from the video sub-system. After sending the bits per pixel values to display device 10, the video sub-system turns on timing channel TC and reads the STATUS code from display device 10. The above described sequence of events is the same in system unit 20 for power on, re-boot, and display resolution mode changes. In display device 10, the above sequence of events is the same for power on and return from a stand-by (eg: power management) state.

Note that the above initialisation sequence allows the video sub-system and display device 10 to have different abilities. The sequence selects the highest mode of operation common to both display device 10 and the video sub-system. It will be appreciated that any other common mode may also be selected by appropriate programming of the video sub-system.

It will be appreciated that embodiments of the present invention hereinbefore described with reference to FIG. 5 are essentially master/slave system in which system unit 20 is always the master. The same initialisation sequence is always followed when a new mode of operation is required, thereby simplifying programming of system unit 20. It will be appreciated that the above initialisation sequence permits automatic configuration of the display system independently of whether any operating system or graphic drivers are loaded into system unit 20.

Returning again to FIG. 2, each of channels I, R, G, B and TC of interface 50 may be formed from any of twisted pair cable, coaxial cable, plastic optical fibre, or glass optical fibre. However, the former three are generally only suitable for use over relatively short distances (eg: less than 10 m). Beyond such distances, signal degradation tends to adversely affect performance of the display system. In some embodiments of the present invention, each of video channels R, G, and B may be implemented in interface 50 by a separate path (eg: wire or fibre). However, in other embodiments of the present invention, a single path may be employed by all of video channels R, G and B with each channel occupying a different portion of the bandwidth of the transmission media and transducers forming the path.

In the embodiments of the present invention hereinbefore described, the speed of transfer of video data via interface 50 may be 15 times greater than the pixel clock speed. In some embodiments of the present invention, the transmission media employed in video channels R, G, and B may differ from that employed in timing channel TC, for example, video channels R, G and B may be implemented by optical fibre and timing channel TC may be implemented by coax. A problem with such arrangements is that the different transmission media have different propagation velocities. The difference in propagation velocity leads to a phase error at display device 10. There is maximum permissible phase error beyond which the original digital video data cannot be recovered by display device 10. The maximum phase error is divided by the relative frequencies of the digital video data and the timing data. Thus, by way of example, for digital video pixel data transmitted with 8 bits of colour information and 1 parity bit, the maximum phase error is reduced from 90 degrees to 10 degrees. It will be appreciated therefore, that in a preferred embodiment of the present invention, the same transmission medium is employed for lo transport of both video and timing data in the interests of preventing skewing between the two. In a particularly preferred embodiment of the present invention, the video and timing data are transmitted over a single optical fibre.

Referring back to FIG. 3, as mentioned hereinbefore, in some applications, palette 200 may vary the logical width of the N bit word to provide a different number of bits per pixel as required. Cross point switch 210 permits reorganisation of signal routing between palette 200 and registers 260–262 to accommodate different numbers of bits per pixel and, in particular, to ensure colour data is routed to the appropriate registers 260–262. It will be appreciated that such re-organisation may involve presentation of data corresponding to more than 1 pixel to registers 260–262 simultaneously. Cross-point 210 also permits re-ordering of pixel data to swap the order in which data is sent to display device 10 from, for example, least significant bit first to most significant bit first, or vice versa. Furthermore, cross-point 210 permits routing of colour data to only one or two video channels instead of all three channels to allow for example communications over a single path, or to maintain communications in the event of failure of one or more channels. It will be appreciated that, in some embodiments of the present invention, cross-point switch 210 may be omitted.

Examples of the present invention have been hereinbefore described with reference to a colour digital display device. It will however be appreciated that the present invention is equally applicable to display systems including monochrome digital display devices.

In the embodiments of the present invention, hereinbefore described, the data stored in the video memory is converted by palette 200 into a colour data set for each pixel of the image to be displayed on display device 10. However, it will be appreciated that other embodiments may be operable in a direct colour mode in which colour data stored in the video memory is transferred directly to the N bit output of palette 200.

What is claimed is:

1. Data processing apparatus for generating serial video bit stream in the form of pulsed pixel data words, comprising:

a pixel clock generator for generating a pixel clock signal;

palette logic for generating a pixel data word on each pulse of the pixel clock signal;

shift clock generator logic for multiplying the pixel clock signal by the number of bits in the pixel data word to produce a shift clock signal; and serialiser logic for outputting the pixel data word in a serial bit stream at the shift clock signal rate.

2. The data processing apparatus as defined in claim 1, further comprising control logic connected to the shift clock generator logic for reading the number of bits in the pixel data word from an external source.

3. The data processing apparatus as defined in claim 1, comprising cross-point switch logic for transferring the pixel data word generated by the palette logic to the serialiser logic.

4. The data processing apparatus as defined in claim 1, comprising error logic for generating an error code corresponding to the pixel data word and for adding the error code to the serial bit stream.

5. The data processing apparatus as defined in claim 2, comprising cross-point switch logic for transferring the pixel data word generated by the palette logic to the serialiser logic.

6. A digital display data processing apparatus comprising:

a display screen for producing a pixel of an image in response to a pixel word;

a timing receiver for receiving a pixel clock signal from an external video source;

shift clock generator logic for multiplying the pixel clock signal by the number of bits in the pixel word to produce a shift clock signal; and deserialiser logic for receiving an input video bit stream at the shift clock signal rate to generate the pixel word.

7. The digital display data processing apparatus as defined in claim 6, comprising control logic connected to the shift clock generator logic for reading the number of bits in the pixel data word from an external source.

8. The digital display data processing an apparatus as defined in claim 6, comprising error logic for detecting an error in the pixel word and from an error code in the serial bit stream.

9. The digital display data processing apparatus as defined in claim 6, wherein the pixel word defines a pixel of a monochrome video image.

10. The digital display data processing apparatus as defined in claim 7, comprising error logic for detecting an error in the pixel word and from an error code in the serial bit stream.

11. The digital display data processing apparatus as defined claim 6, wherein the pixel word defines a colour component of a pixel of a colour video image.

12. A data processing display system, comprising:

a digital video source coupled to a digital display device through a digital interface having a timing channel for carrying a pixel clock signal from the digital video source to the digital display device and a digital video channel for carrying a digital video bit stream from the digital video source to the digital display device, wherein the digital video source includes a pixel clock generator for generating the pixel clock signal, palette logic for outputting a pixel word on each pulse of the pixel clock signal, first shift clock logic for multiplying the pixel clock signal by the number of bits in the pixel word to produce a shift clock signal, and serialiser logic for serially outputting the pixel word in the serial bit stream at the shift clock signal rate, and wherein the digital display device includes a display screen for producing a pixel of an image in response to the pixel word, second shift clock logic for multiplying the pixel clock signal by the number of bits in the pixel word, and deserialiser logic for receiving the input video bit stream at the shift clock signal rate to re-generate the pixel word from the video bit stream.

13. The data processing display system, as defined in claim 12, wherein the interface comprises a control channel for communicating the number of bits in the pixel word from the digital video source to the digital display device.

14. A computer system comprising.

a processor;

a memory; and a display system including a digital video source coupled to a digital display device through a digital interface having a timing channel for carrying a pixel clock signal from the digital video source to the digital display device, and a digital video channel for carrying a digital video bit stream from the digital video source to the digital display device, wherein the digital video source includes a pixel clock generator for generating the pixel clock signal, palette logic for outputting a pixel word on each pulse of the pixel clock signal, first shift clock logic for multiplying the pixel clock signal by the number of bits in the pixel word to produce a shift clock signal, and serialiser logic for serially outputting the pixel word in the digital video bit stream at the shift clock signal rate, and wherein the digital display device includes a display screen for producing a pixel of an image in response to the pixel word, second shift clock logic for multiplying the pixel clock signal by the number of bits in the pixel word, and deserialiser logic for receiving the serially outputted pixel word in the digital video bit stream from the serialiser logic at the shift clock signal rate to re-generate the pixel word from the digital video bit stream.

* * * * *